US005921804A

United States Patent [19]

Nagai

[11] Patent Number: 5,921,804

[45] Date of Patent: Jul. 13, 1999

[54] PRESS-CONNECTING TERMINAL, AND ITS HOUSING

[75] Inventor: Kentaro Nagai, Shizuoka, Japan

[73] Assignee: Yazaki Corporation, Tokyo, Japan

[21] Appl. No.: 09/050,349

[22] Filed: Mar. 31, 1998

[30] Foreign Application Priority Data

Apr. 3, 1997 [JP] Japan ..... 9-085164

[51] Int. Cl.[6] ..... H01R 4/24

[52] U.S. Cl. ..... 439/397

[58] Field of Search ..... 439/397, 398, 439/399, 400, 406, 407

[56] References Cited

U.S. PATENT DOCUMENTS

| | | | |
|---|---|---|---|
| 3,926,498 | 12/1975 | Hoppe et al. | 439/406 |
| 4,160,574 | 7/1979 | DeRoss | 439/406 |
| 4,264,118 | 4/1981 | Nijman | 439/400 |
| 4,840,578 | 6/1989 | Sato | 439/407 |
| 5,427,544 | 6/1995 | Okabe | 439/397 |
| 5,554,046 | 9/1996 | Sugiyama et al. | 439/397 |

FOREIGN PATENT DOCUMENTS

| | | | |
|---|---|---|---|
| 62-150868 | 9/1987 | Japan | H01R 4/24 |

*Primary Examiner*—Steven L. Stephan
*Assistant Examiner*—J. F. Duverne
*Attorney, Agent, or Firm*—Sughrue, Mion, Zinn, Macpeak & Seas, PLLC

[57] ABSTRACT

A press-connecting terminal includes a bottom plate, a pair of side plates which are extended upwardly in the same direction from opposite sides of the bottom plate, and a pair of press-contact blades which are extended from the pair of side plates and are opposed to each other in such a manner that they are located above the bottom plate. In the press-connecting terminal, an end portion of a covered wire is press-fitted in between the press-contact blades so that a conductor of the covered wire is electrically connected to the press-contact blades. The press-connecting terminal further includes a wire accommodating section (e.g., a hole (17) or an arcuate recess (23)) which is formed in the bottom plate such that the wire accommodating section is located below the press-contact blades. In the press-connecting terminal, the covered wire is press-fitted in between the press-contact blades, and a part of a cover of the covered wire on the bottom plate side is set in the wire accommodating section. This increases the holding force of the press-contact blades on the conductor.

7 Claims, 6 Drawing Sheets

PRESS-CONNECTING TERMINAL, AND ITS HOUSING

BACKGROUND OF THE INVENTION

1. Field of the Invention

This invention relates to a press-connecting terminal in which an end portion of a covered wire is press-fitted in between press-contact blades so that the press-connecting terminal is electrically connected to the covered wire, and also relates to a housing accommodating the press-connecting terminal.

2. Background

FIG. 6 shows a press-connecting terminal 1 disclosed by Unexamined Japanese Utility Model Publication No. Sho. 62-150868. The press-connecting terminal 1 has a contact section 2 for mating with another terminal on one side thereof, and a wire holding section 3 on the other side thereof. The wire holding section 3 has a pair of wire holding pieces 4 and 4 on the rear end side of the press-connecting terminal 1. A press-contact section 5 is formed between the contact section 2 and the wire holding pieces 4. The contact section 5 includes a bottom plate 6, a pair of side plates 7 and 7 which are extended upwardly from opposite sides of the bottom plate 6, and a pair of press-contact blades 8 and 8 which are opposed to each other and are extended from the side plates 7 and 7 in such a manner that they stand above the bottom plate 6.

As shown in FIGS. 7 and 8, the end portion of the covered wire 9 is press-fitted in between the press-contact blades 8 and 8, so that the conductor (core wire) 10 of the covered wire 9 is electrically connected to the press-contact blades 8.

However, as shown in FIG. 9, when the covered wire 9 is press-fitted in between the press-contact blades 8 and 8, the cover 11 of the covered wire 9 abuts against the bottom plate 6, so that the conductor 10 is located above the bottom plate 6 as much as the thickness L1 of the cover 11. Hence, the portions of the press-contact blades 8 on the bottom plate 6 side are not used. Accordingly, a sufficient contact load between the conductor 10 and the press-contact blades 8 may not be obtained.

The pair of side plates 7 and 7 are extended in the same direction from the opposite sides of the bottom plate 6. The portions of the side plates 7 and 7 on the bottom plate 6 side are difficult to open outwardly when compared with their upper side portions. That is, the holding force (the contact load) for holding the conductor 10 at the portions of the side plates 7 and 7 on the bottom plate 6 side are higher than the upper side portions. However, since the conductor 10 held between the press-contact blades 8 and 8 is positioned away from the bottom plate 6 as much as the thickness L1 of the cover 11 of the covered wire 9, the sufficient contact load for the conductor 10 may not be obtained.

SUMMARY OF THE INVENTION

In view of the foregoing, an object of the invention is to provide a press-connecting terminal in which a high contact load for the conductor of a covered wire held between portions of a pair of press-contact blades on a bottom plate side is obtained, and a housing accommodating the press-connecting terminal.

According to the first aspect of the invention, there is provided a press-connecting terminal which includes: a bottom plate; a pair of side plates which are extended upwardly in the same direction from opposite sides of the bottom plate; a pair of press-contact blades which are extended from the pair of side plates and are opposed to each other in such a manner that they are located above the bottom plate, in which an end portion of a covered wire is press-fitted in between the press-contact blades so that a conductor of the covered wire is electrically connected to the press-contact blades; and a wire accommodating section is formed in the bottom plate in such a manner that the wire accommodating section is located below the press-contact blades, in which the covered wire is press-fitted in between the press-contact blades, and a part of a cover of the covered wire on the bottom plate side is set in the wire accommodating section.

In the press-connecting terminal, the end portion of the covered wire is press-fitted in between the pair of press-contact blades until the end portion is set between the portions of the press-contact blades on the bottom plate side, and a part of the cover of the covered wire is inserted in the wire accommodating section formed in the bottom plate. Accordingly, since the conductor of the covered wire is located more closely to the bottom plate side, the conductor is held between the pair of press-contact blades with high contact load.

According to the second aspect of the present invention, the wire accommodating section may be a through-hole formed in the bottom plate.

In the press-connecting terminal, the cover of the covered wire press-fitted in between the pair of press-contact blades is protruded downwardly through the through hole formed in the bottom plate. Therefore, the conductor of the covered wire is located more closely to the portions of the press-contact blades on the bottom plate side, and is held between the press-contact blades with high contact load.

According to the third aspect of the present invention, the press-connecting terminal may be accommodated in a housing which includes a terminal accommodating groove having a bottom wall on which the bottom plate of the press-connecting terminal is set, and inner walls confronted with each other. Further, a recess is formed in the bottom wall which is confronted with the wire accommodating section of the bottom plate of the press-connecting terminal. Accordingly, a part of the cover of the covered wire is accommodated in the recess.

In the housing, upon press-insertion of the covered wire in between the press-contact blades of the press-connecting terminal set in the terminal accommodating groove, the cover of the cover wire which has passed through the bottom plate is accommodated in the recess. In the case where the wire accommodating section is formed in the bottom plate such that the wire accommodating section is protruded towards the bottom wall of the housing, the wire accommodating section is accommodated in the recess together with the cover, so that the conductor of the covered wire is located on the bottom plate side. Accordingly, the conductor is set in between the press-contact blades with high contact load.

BRIEF DESCRIPTION OF THE DRAWINGS

FIG. 4B is a sectional view showing relationships between the housing according to the second embodiment and the press-connecting terminal according to the first embodiment;

DETAILED DESCRIPTION OF THE PREFERRED EMBODIMENTS

Preferred embodiments of the invention will be described with reference to the accompanying drawings.

First Embodiment

Figure 1:
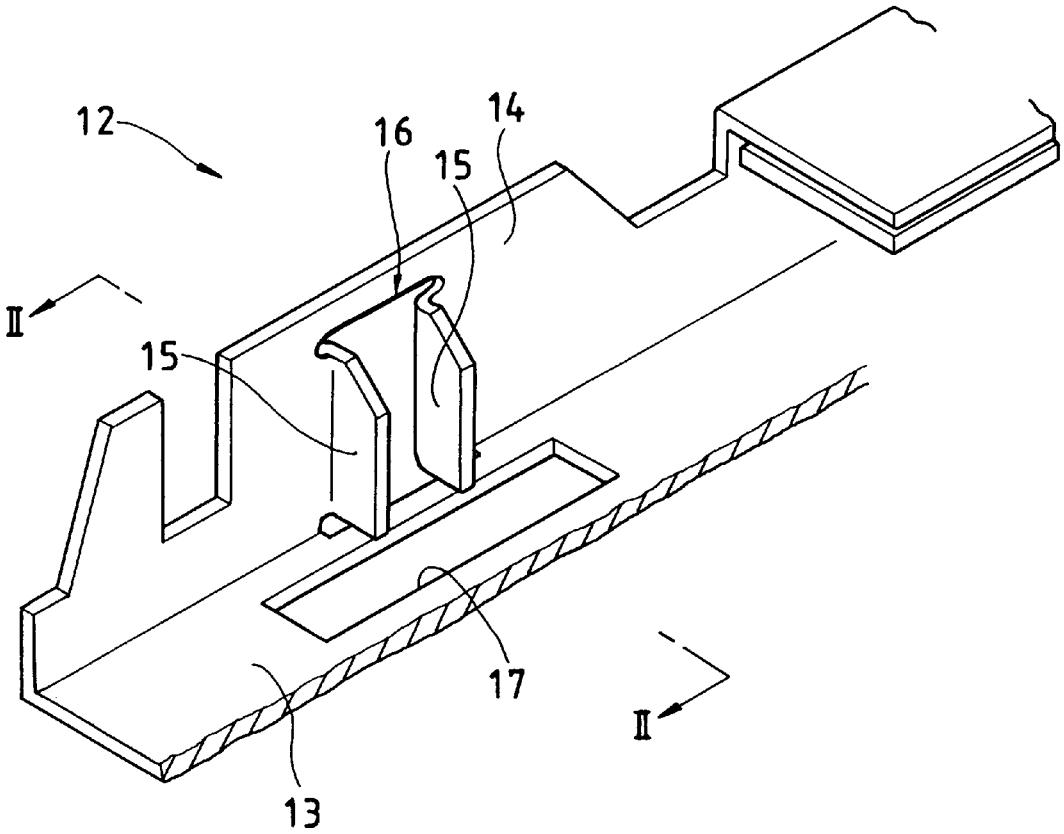
FIG. 1 is a perspective view showing a part of a press-connecting terminal according to a first embodiment of the present invention.
Figure 2:
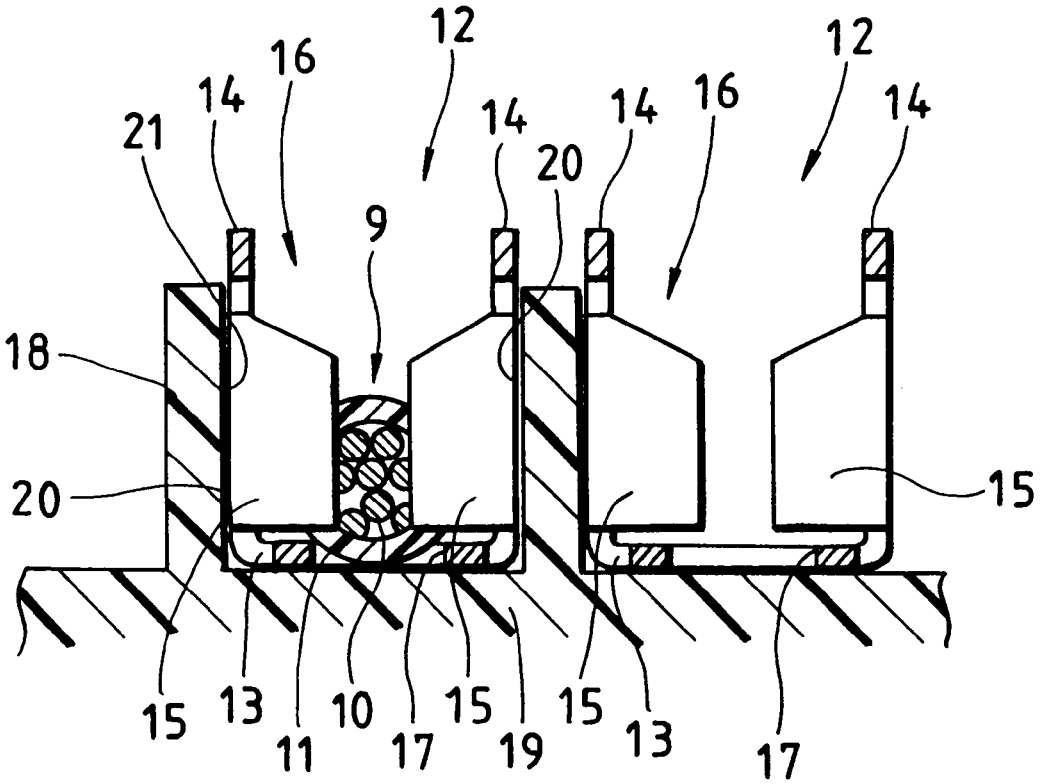
FIG. 2 is a sectional view taken along line II—II in FIG. 1.

In FIGS. 1 and 2, reference numeral 12 designates a press-connecting terminal according to a first embodiment of the present invention.

The press-connecting terminal 12 includes: a bottom plate 13; a pair of side plates 14 and 14 which are extended upwardly and in the same direction from opposite sides of the bottom plate 13; and a press-contact section 16 including a pair of press-contact blades 15 and 15 which are cut and bent such that the press-contact blades 15 and 15 are confronted with each other above the bottom plate 13. The bottom plate 13 located below the press-contact blades 15 and 15 has a rectangular through-hole 17.

As shown in FIG. 2, a housing 18 accommodating the press-connecting terminals 12 includes a terminal accommodating grooves 21 each having a bottom wall 19 on which the bottom plate 13 of the press-connecting terminal 12 is set and inner walls 20 and 20 confronted with each other.

A cover 11 of a covered wire 9 is press-fitted in between the press-contact blades 15 and 15 to be inserted into the through-hole 17. Accordingly, a conductor (or core wire) 10 of the covered wire 9 is held and located between the press-contact blades 15 and 15 on the bottom plate 13 side.

According to the first embodiment, since the through-hole 17 is formed in the bottom plate 13 of the press-connecting terminal 12, and a part of the cover 11 of the covered wire 9 is located in the through-hole 17 so that the conductor 10 is positioned on the bottom plate 13 side when the covered wire 9 is press-fitted in between the press-contact blades 15 and 15, the high contact load is sufficiently obtained.

In accordance with the high contact load, the covered wire 11 is positively held.

Furthermore, it is unnecessary to increase the height of the press-contact blades 15 and 15. Since the height of the press-contact blades 15 may be at least about the outside diameter of the covered wire 9, this feature contributes to miniaturizing the press-contact section 16.

Second Embodiment

A press-connecting terminal 22 according to a second embodiment of the present invention will now be described with reference to FIGS. 3, 4A and 4B. Parts of the press-connecting terminal 22 corresponding functionally to the first embodiment are designated by the same reference numerals or characters.

Figure 3:
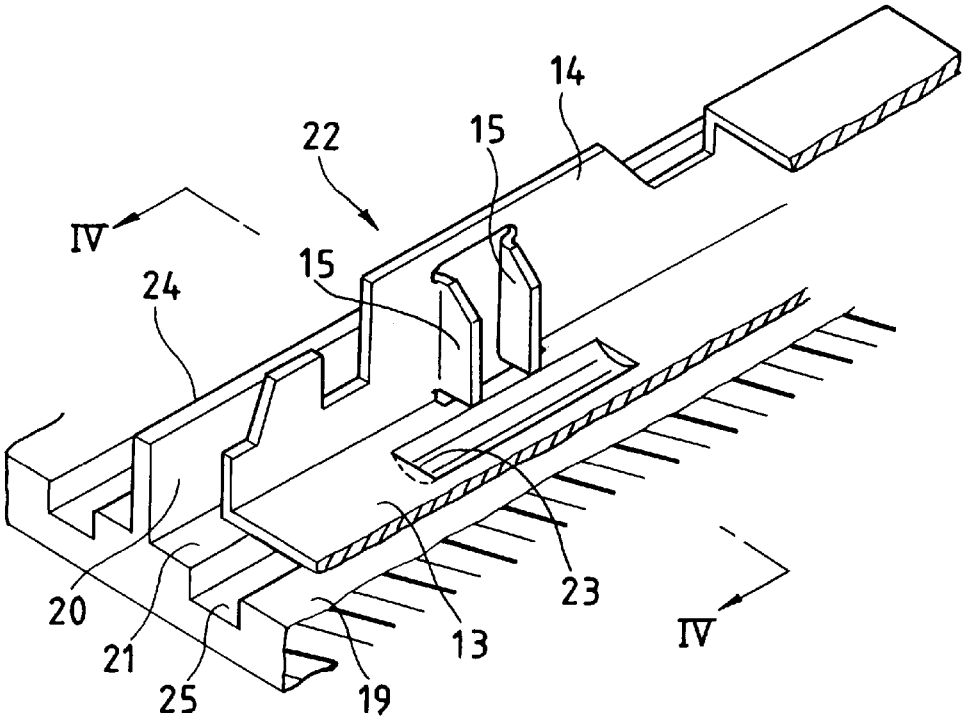
FIG. 3 is a perspective view showing a part of a press-connecting terminal according to a second embodiment of the present invention.
Figure 4A:
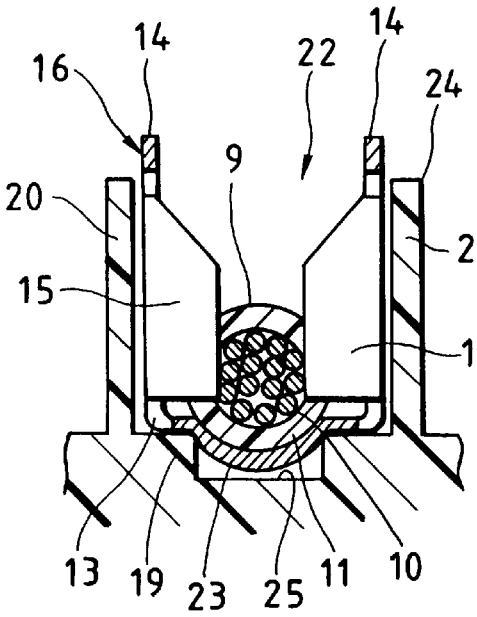
FIGS. 4A and 4B each shows a sectional view taken along line IV—IV in FIG. 3, but FIG. 4A is a sectional view showing relationships between a housing and the press-connecting terminal according to the second embodiment.

In the press-connecting terminal 22, as shown in FIG. 3, an arcuate recess 23 is formed in the bottom plate 13 to be protruded outwardly. On the other hand, a housing 24 accommodating the press-connecting terminal 22 has a recess 25 in the bottom wall 19 of a terminal accommodating groove 21. The arcuate recess 23 of the press-connecting terminal 22 is accommodated in the recess 25.

The cover 11 of the covered wired 9 is press-fitted in between a pair of press-contact blades 15 and 15, and a part of the cover 11 is set in the recess 23 formed in the bottom plate 13 of the press-connecting terminal 22. Accordingly, the conductor (or core wire) 10 of the covered wire 9 is held and located between the portions of the press-contact blades 15 on the bottom plate 13 side. Since the conductor 10 of the covered wire 9 is positioned between the portions of the press-contact blades 15 and 15 on the bottom plate 13 side, high contact load for the conductor is sufficiently obtained.

Since the conductor 10 is held with higher contact load, high wire holding force is positively obtained.

Figure 4B:
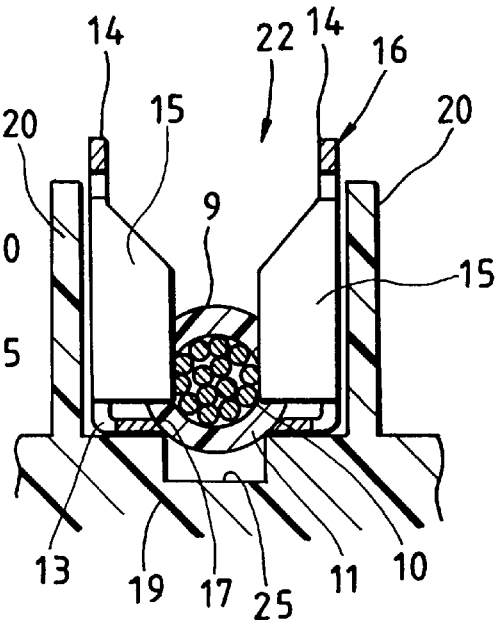

In the case where the recess 25 is formed in the bottom wall 19 of the terminal accommodating groove 21 of the housing 24, the press-connecting terminal 12 according to the first embodiment also may be set in the terminal accommodating groove 21 as shown in FIG. 4B. In this case, a part of the cover 11 of the covered wire 9 is set in the recess 25 through the through-hole 17.

Third Embodiment

Figure 5:
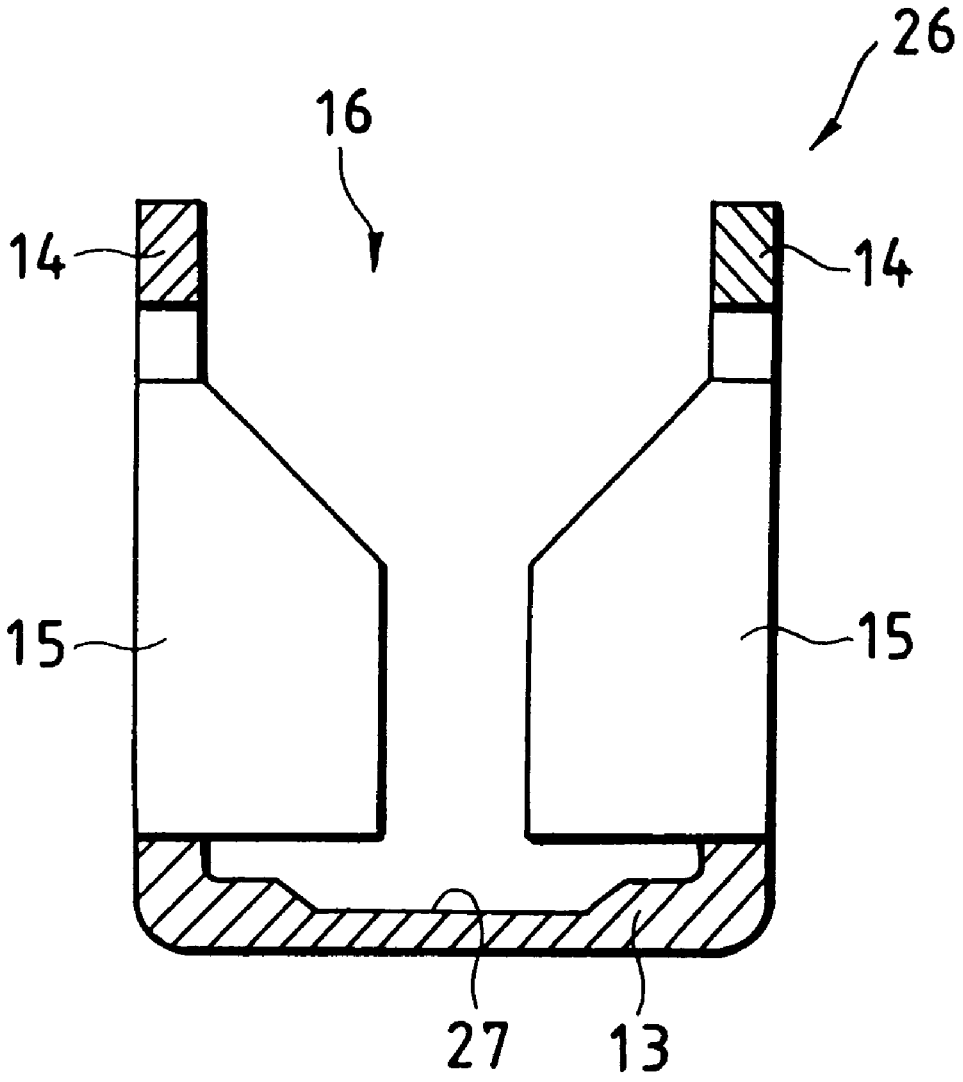
FIG. 5 is a sectional view showing a press-connecting terminal according to a third embodiment of the present invention.
Figure 6:
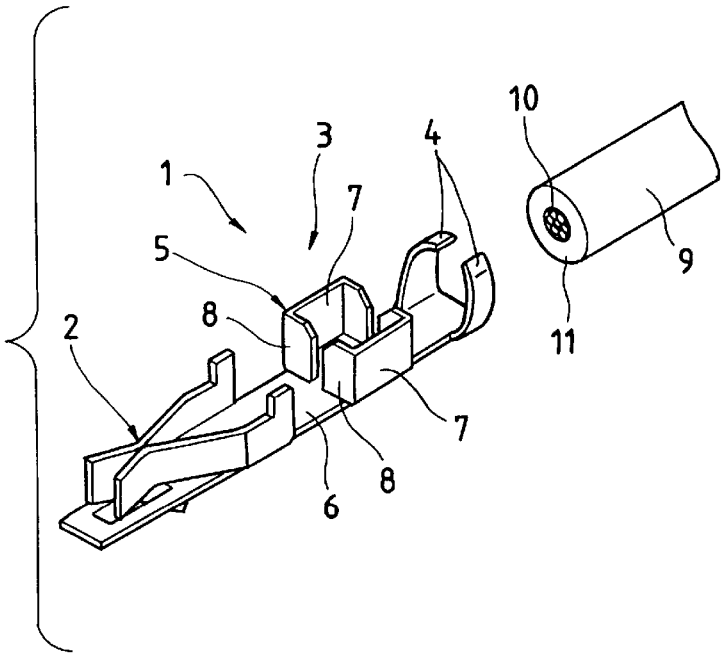
FIG. 6 PRIOR ART
FIG. 6 is a perspective view showing a conventional press-connecting terminal.
Figure 7:
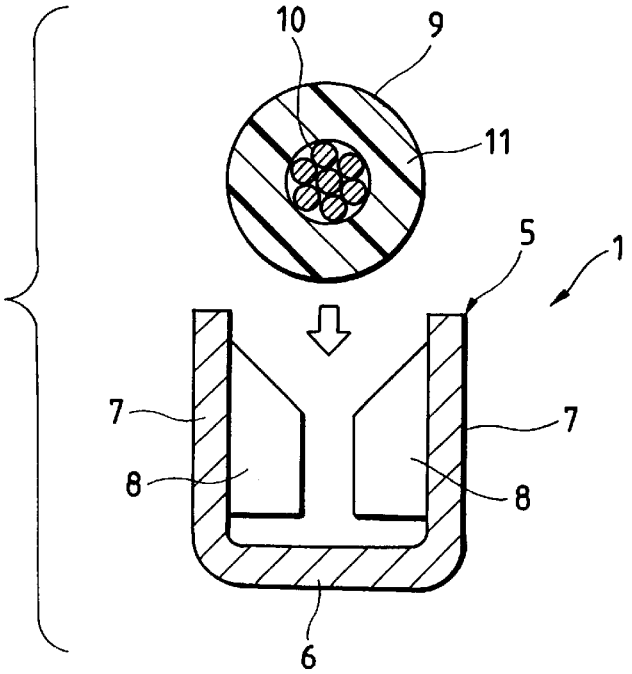
FIG. 7 PRIOR ART
FIG. 7 is a sectional view showing relationships between the conventional press-connecting terminal and a covered wire.
Figure 8:
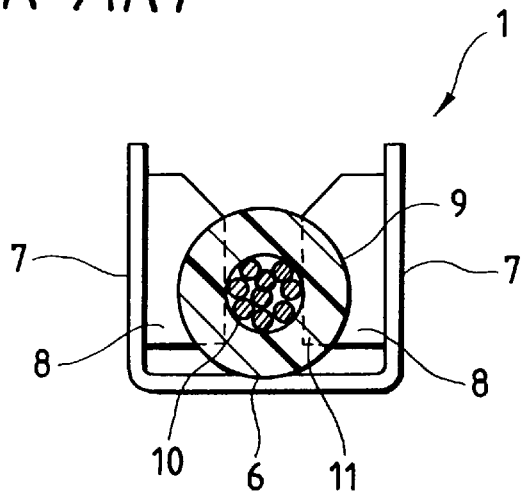
FIG.8 PRIOR ART
FIG. 8 is a section view showing the covered wire which is press-fitted in the conventional press-connecting terminal.
Figure 9:
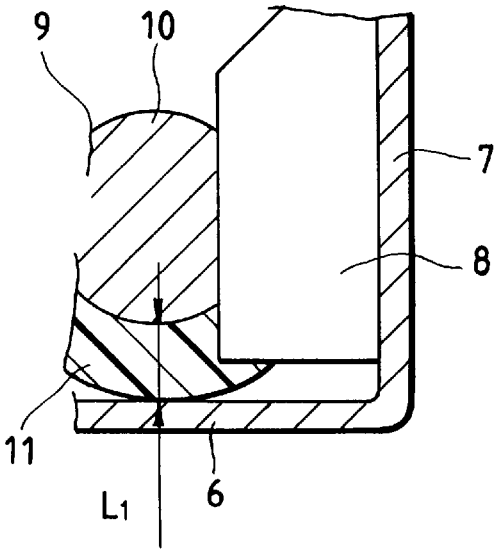
FIG.9 PRIOR ART
FIG. 9 is a sectional view showing relationships between the bottom wall of the conventional press-connecting terminal and the cover of the covered wire.

A press-connecting terminal 26 according to a third embodiment of the present invention will now be described with reference to FIG. 5. In the press-connecting terminal 26, a bottom plate 13 has a recess 27 which is formed by reducing the thickness of the bottom plate 13 with a press and so on.

The covered wire 9 is set in between press-contact blades 15 and 15, and a part of the cover 11 of the covered wire 9 is set in the recess 27. Since the recess 27 is formed, the conductor 10 of the covered wire 9 can be positioned the portions of the press-contact blades 15 and 15 on the bottom plate 13 side, similar to the first and second embodiments. This feature provides a high contact load for the conductor.

What is claimed is:

1. A terminal, comprising:

a bottom plate;

a pair of side plates extending upwardly in the same direction from opposite sides of the bottom plate;

press-contact blades extended respectively from the side plates to be opposed to each other, the press-contact blades being located above the bottom plate, the press-contact blades between which a wire including a cover and a conductor covered with the cover is insertable so that the conductor of the wire is electrically connected to the press-contact blades; and a recessed portion formed in the bottom plate to be located directly vertically below the press-contact blades, wherein when the wire is inserted between the press-contact blades, a part of the cover of the wire is received in the recessed portion.

2. The terminal of claim 1, wherein the recessed portion is a through-hole formed in the bottom plate.

3. The terminal of claim 1, wherein the recessed portion projects from the bottom plate outwardly.

4. A housing for accommodating a terminal which comprises a bottom plate, a pair of side plates extending upwardly in the same direction from opposite sides of the bottom plate, press-contact blades extended respectively from the side plates to be opposed to each other, the press-contact blades being located above the bottom plate, the press-contact blades between which a wire including a cover and a conductor covered with the cover is insertable so that the conductor of the wire is electrically connected to the press-contact blades, and a recessed portion formed in the bottom plate to be located directly vertically below the press-contact blades, wherein when the wire is inserted between the press-contact blades, a part of the cover of the wire is received in the recessed portion, said housing comprising:

a terminal accommodating groove including a bottom wall on which the bottom plate of the terminal is set, and inner walls confronted with each other; and a recess formed in the bottom wall which is confronted with the recessed portion of the bottom plate when the terminal is accommodated in the terminal accommodating groove.

5. The housing of claim 4, wherein when the terminal is accommodated in the terminal accommodating groove, the part of the cover of the wire is accommodated in the recess.

6. The housing of claim 4, wherein the recessed portion projects from the bottom plate outwardly, and wherein when the terminal is accommodated in the terminal accommodating groove, a part of the recessed portion is accommodated in the recess.

7. The housing of claim 4, wherein the recessed portion is a through-hole formed in the bottom plate.

* * * * *